US006000553A

United States Patent [19]

Cohen et al.

[11] Patent Number: 6,000,553

[45] Date of Patent: Dec. 14, 1999

[54] MULTIPLE SCREEN SYSTEM

[75] Inventors: Douglas J. Cohen; Mauricio A. Escobar, both of Columbus, Ohio

[73] Assignee: Ohio Central Steel Company, Reynoldsburg, Ohio

[21] Appl. No.: 09/175,074

[22] Filed: Oct. 19, 1998

[51] Int. Cl.[6] ..... B07B 1/28

[52] U.S. Cl. ..... 209/313; 209/319; 209/365.4; 209/420

[58] Field of Search ..... 209/309, 311, 209/313, 319, 364, 365.1, 365.4, 420, 421

[56] References Cited

U.S. PATENT DOCUMENTS

| | | | |
|---|---|---|---|
| 4,197,194 | 4/1980 | Read . | |
| 4,237,000 | 12/1980 | Read et al. . | |
| 4,256,572 | 3/1981 | Read . | |
| 4,923,597 | 5/1990 | Anderson et al. . | |
| 5,106,490 | 4/1992 | McDonald . | |
| 5,219,078 | 6/1993 | Hadden | 209/319 X |
| 5,301,815 | 4/1994 | Chauvin et al. | 209/365.4 |

FOREIGN PATENT DOCUMENTS

| | | | |
|---|---|---|---|
| 1554991 | 4/1990 | U.S.S.R. | 209/313 |

*Primary Examiner*—Tuan N. Nguyen
*Attorney, Agent, or Firm*—Jason H. Foster; Kremblas, Foster, Millard & Pollick

[57] ABSTRACT

A screening plant including a housing to which first and second screen boxes are reciprocatably mounted. The screen boxes are coplanar and the inner peripheral edge of the first box is adjacent the inner peripheral edge of the second box. Separate prime movers, such as hydraulic motors, are drivingly linked to the independently mounted screen boxes. The screen boxes are separated by a gap over which a beveled cap is mounted.

9 Claims, 6 Drawing Sheets

MULTIPLE SCREEN SYSTEM

BACKGROUND OF THE INVENTION

1. Field of the Invention

The invention relates generally to devices used to separate construction and mining materials by size, and more specifically relates to screening plants, which use vibrating screens of varying meshes to separate matter poured onto the screens.

2. Description of the Related Art

Conventional screening plants have been in use for some time. Such machines are used to separate materials, such as road construction debris, gravel, soil, sand and recyclables. Examples of conventional screening plants are shown in many U.S. Patents, such as U.S. Pat. No. 5,106,490 to McDonald and U.S. Pat. No. 4,923,597 to Anderson et al.

Conventional screening plants include a wide upper screen which is angled relative to horizontal, onto which material is poured. The screen vibrates, causing pieces of matter that are larger than the apertures to slide down the angled screen onto a pile of larger pieces of matter that collect on one side of the machine. Matter that is smaller than the apertures in the upper screen drops through the apertures, typically onto a second angled screen with smaller apertures, to be separated further. Screening plants are often portable, permitting them to be transported to the location where excavation, mining or construction takes place.

The drive mechanism for most screening plants includes an internal combustion engine that powers a pump for pressurizing hydraulic fluid. An example of such a mechanism is disclosed in U.S. Pat. No. 4,237,000 to Read. The fluid is pumped to a hydraulic motor that rotates a driveshaft with an attached eccentric, vibrating the screen box. The screen box typically includes an attached stack of similarly angled, parallel screens with progressively smaller apertures on each lower screen. Therefore, only the finer particulate matter, such as sand, passes through the lowest screen layer. This finer particulate matter is often conveyed by an elevating conveyor from beneath the primary screen apparatus to a pile spaced from the machine.

Problems arise from the use of conventional screening plants. The materials are normally poured onto the upper screen layer by the bucket of an excavating loader. The buckets of excavating loaders used to pour the material into the screening plants have a minimum size. Therefore, the width of the screen box, which is the distance, W, in FIG. 1, should not be significantly less than the width of the smallest normal bucket, which is about five feet. However, the stresses induced in a single screen box that is greater than five feet wide by a full bucket of material is significant, often resulting in the frame members of the screen box bending or breaking. The length, L, of the screen box is shown in FIG. 2.

Improvements have been made to the conventional screen box to reduce damage by heavy materials. These improvements include central support members extending between the frame members of the upper screen and the frame members of a lower screen. Such a support member is shown in U.S. Pat. No. 4,256,572 to Read. The support member distributes, among the frames of lower screens, some of the stress applied to the upper screen's frame due to the weight of the material dropped thereon. These improvements have reduced the damage, but they have not eliminated it.

The conventional screens used on screening plants are also expensive to design and make. Such screens must have long, extremely strong screen box frame members. Additionally, each member must be continuous across the screen box, without seams which are subject to breakage under the stresses induced by the large loads. Furthermore, the drive system needed to reciprocate large screen boxes must be extremely robust and therefore expensive, including a single vibrating driveshaft extending the entire width of the screen.

When the width of a conventional screening plant is increased, there is a disproportionate decrease in available amplitude of oscillation (called "throw"), there is a disproportionate loss of the ability to screen large matter and the manufacturing cost increases disproportionately to the increase in width.

Therefore, the need exists for an improved screening plant including screens and screen frames that are less susceptible to damage and more cost efficient to build. Additionally, such a screening plant should be able to be made wider with only a proportional increase in cost, and no decrease in ability to screen large material.

SUMMARY OF THE INVENTION

The invention comprises a screening plant having a housing including a funnel region into which matter is poured. The screening plant comprises a first screen box mounted to the housing in the funnel region. The first screen box has an inner peripheral edge. A first prime mover is drivingly linked to the first screen box for driving the first screen box in reciprocating motion. A second screen box is mounted to the housing in the funnel region. The second screen box has an inner peripheral edge which is mounted adjacent to the first screen box's inner peripheral edge. The second screen box is substantially coplanar with the first screen box. A second prime mover is drivingly linked to the second screen box for driving the second screen box in reciprocating motion. Additional screen boxes and drivingly linked prime movers can be added in a modular manner with no loss in the ability to screen large material, no loss in ability to increase amplitude and only a proportional increase in cost.

One advantage of the present invention is the ability to drive the multiple screen boxes independently from one another by the separate prime movers, which are preferably, but not necessarily, hydraulic motors. Another advantage is the strength that arises from each screen box being narrower than a single wide screen box. The sum total weight that the array of screen boxes can support is much greater than the sum total weight a single conventional screen box can support. Additional advantages include the strength of separate smaller drive systems for independent screen boxes, and the lower cost of adding such separate independent screen boxes in a modular manner.

Figure 1:
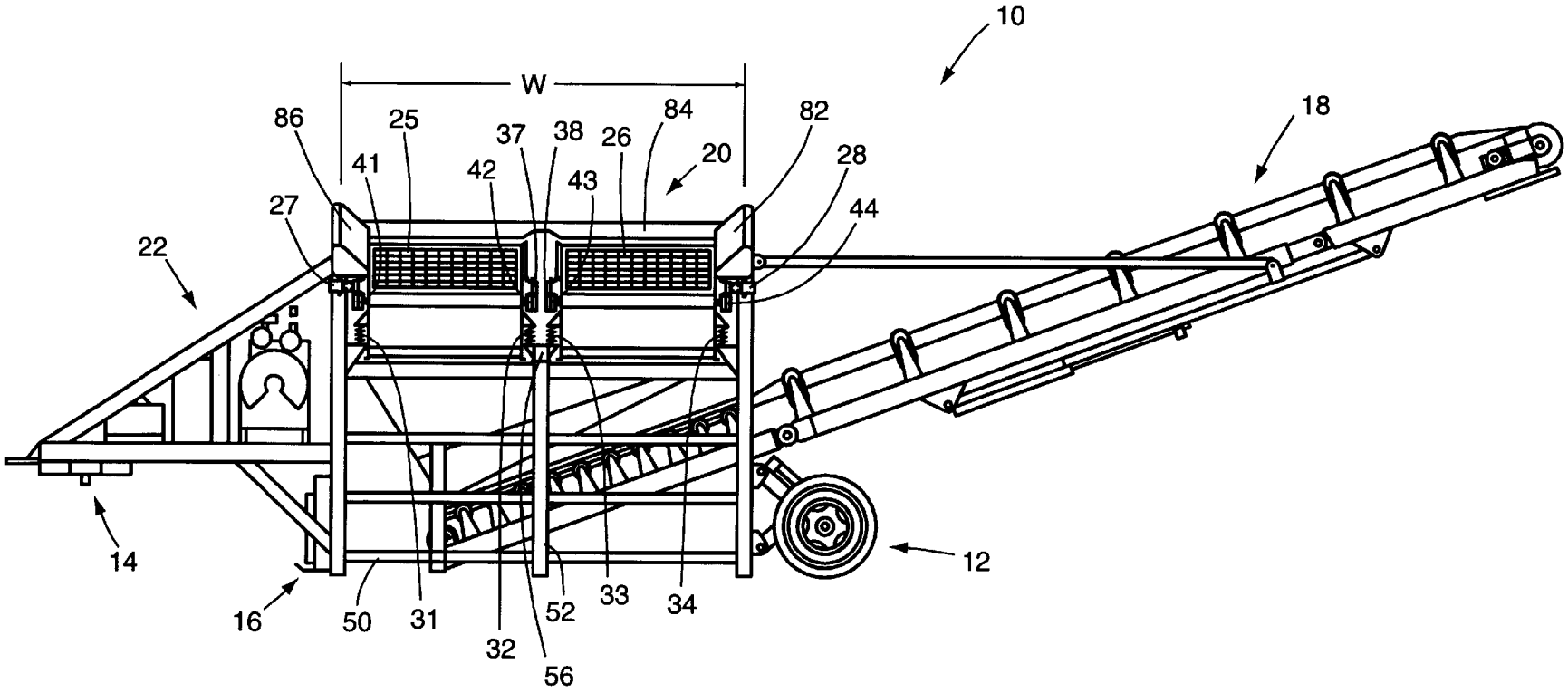
FIG. 1 is a side view illustrating a preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

BRIEF DESCRIPTION OF THE PREFERRED EMBODIMENT

The preferred screening plant 10 is shown in FIG. 1. The screening plant 10 has several major components that are conventionally used on screening plants. The wheels 12 and the fifth wheel pin 14 permit towing of the entire plant. The wheels 12 and the feet 16 can be raised and lowered for resting the housing 20 of the screening plant 10 directly on the earth. The feet 16 are used to level the structure, if necessary. An elevating conveyor 18 conveys the finer particulate matter from beneath the separating portion of the screening plant 10 onto a pile or into the bed of a vehicle. The powerplant 22 is rigidly mounted to the housing 20, and preferably includes an internal combustion engine, a fuel tank, a hydraulic pump, and a hydraulic fluid reservoir.

The housing 20 includes the frame 50 and the attached walls (shown in FIG. 2) that enclose the frame 50. Material is poured, during operation, into the funnel region made up of the slanted walls 82, 84 and 86 and the housing elements in close proximity thereto.

In addition to the conventional components discussed above, the invention has new features, including intermediate vertical housing supports, such as the front leg 52 and rear leg 54 (not visible in FIG. 1). These legs support opposite ends of a horizontal support member, preferably the beam 56. The beam 56 preferably extends horizontally from the top of the front leg 52 to the top of the rear leg 54. The front leg 52 and rear leg 54 extend downwardly from opposite ends of the beam 56, forming a foot at their lower end for resting on the earth, although resting on the earth is not necessary. The inner peripheral edges of the screen boxes 25 and 26 rest upon the beam 56 (as described below), and the front and rear legs 52 and 54 support the beam 56 against the downwardly directed force applied to the beam 56 by the screen boxes 25 and 26.

Figure 3:
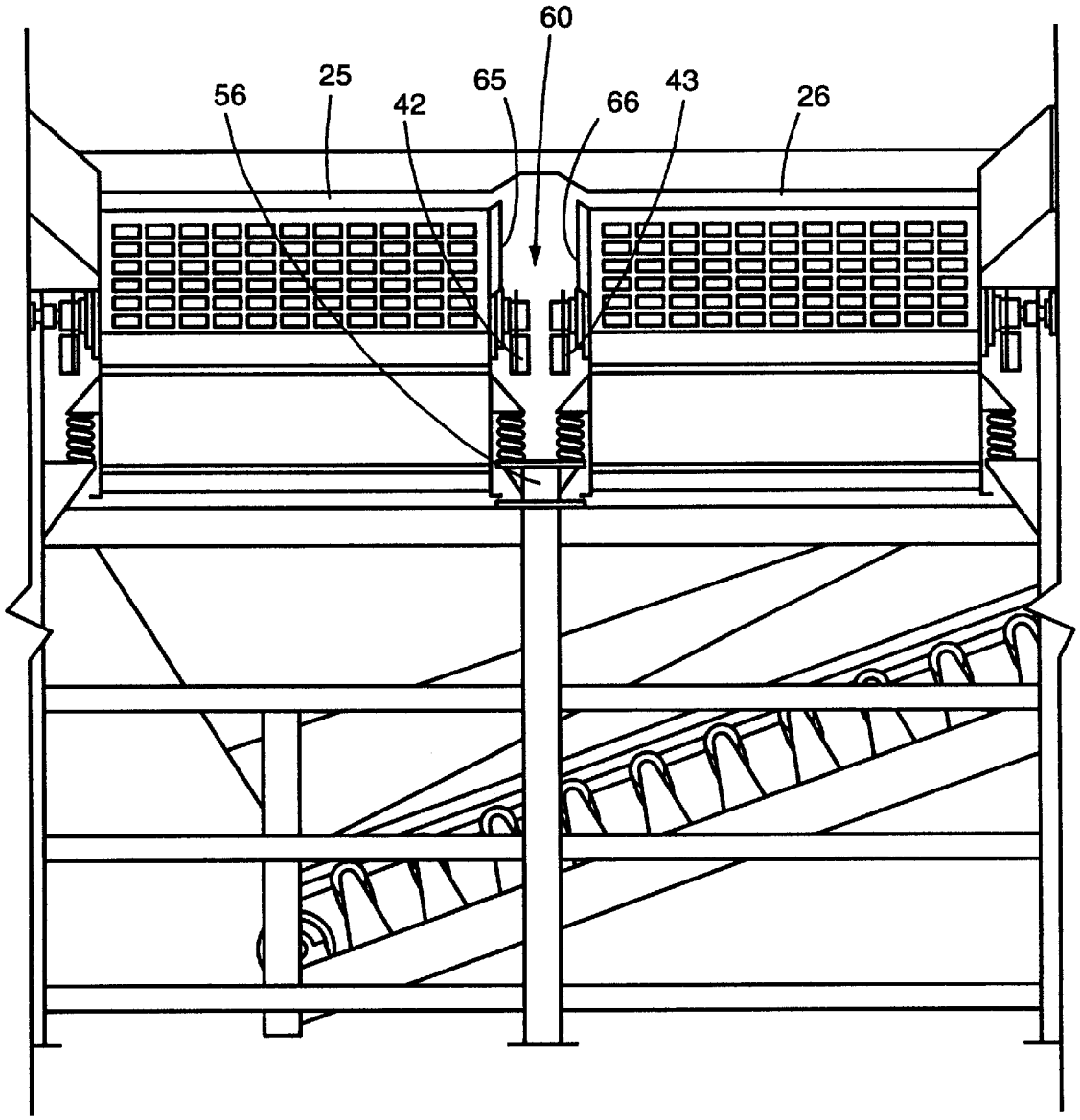
FIG. 3 is a side view illustrating the preferred screen boxes and drive systems.

Referring to FIGS. 1 and 3, the screen box 25 is mounted to biases, preferably the coil springs 31 and 32, which are mounted to the housing 20, preferably the beam 56. The second screen box 26 is essentially identical to the first screen box 25, and is similarly mounted to biases, preferably the coil springs 33 and 34, which are mounted to the housing 20, preferably the beam 56. The upper screens of the screen boxes 25 and 26 are substantially coplanar, giving the screening plant 10 an effective upper screen surface area similar to conventional screening plants that have a single screen box. However, significant advantages over conventional screening plants arise from the use of two, and potentially three or more, screen boxes on a single screening plant.

The prime movers, preferably the hydraulic motors 27 and 28, which alternatively could be electric motors or some equivalent prime mover, have rotating drive shafts that attach to the driven shafts 37 and 38, respectively. The driven shafts 37 and 38 extend through the frame members of the screen boxes 25 and 26, respectively. The eccentric weights 41, 42, 43 and 44 are mounted to the driven shafts 37 and 38 at points offset from the axes of the driven shafts 37 and 38. Therefore, when the hydraulic motors 27 and 28 rotate the driven shafts 37 and 38, the eccentric weights revolve around the driven shafts 37 and 38, causing vibratory reciprocation of the driven shafts 37 and 38.

The coil springs 31–34 securely mount the screen boxes 25 and 26 to the housing 20, while permitting vibratory reciprocation of the screen boxes. Of course, the preferred coil springs 31–34 could be equivalently substituted by any conventional bias, such as blocks of resilient material, or leaf, magnetic or fluid springs, etc.

Figure 2:
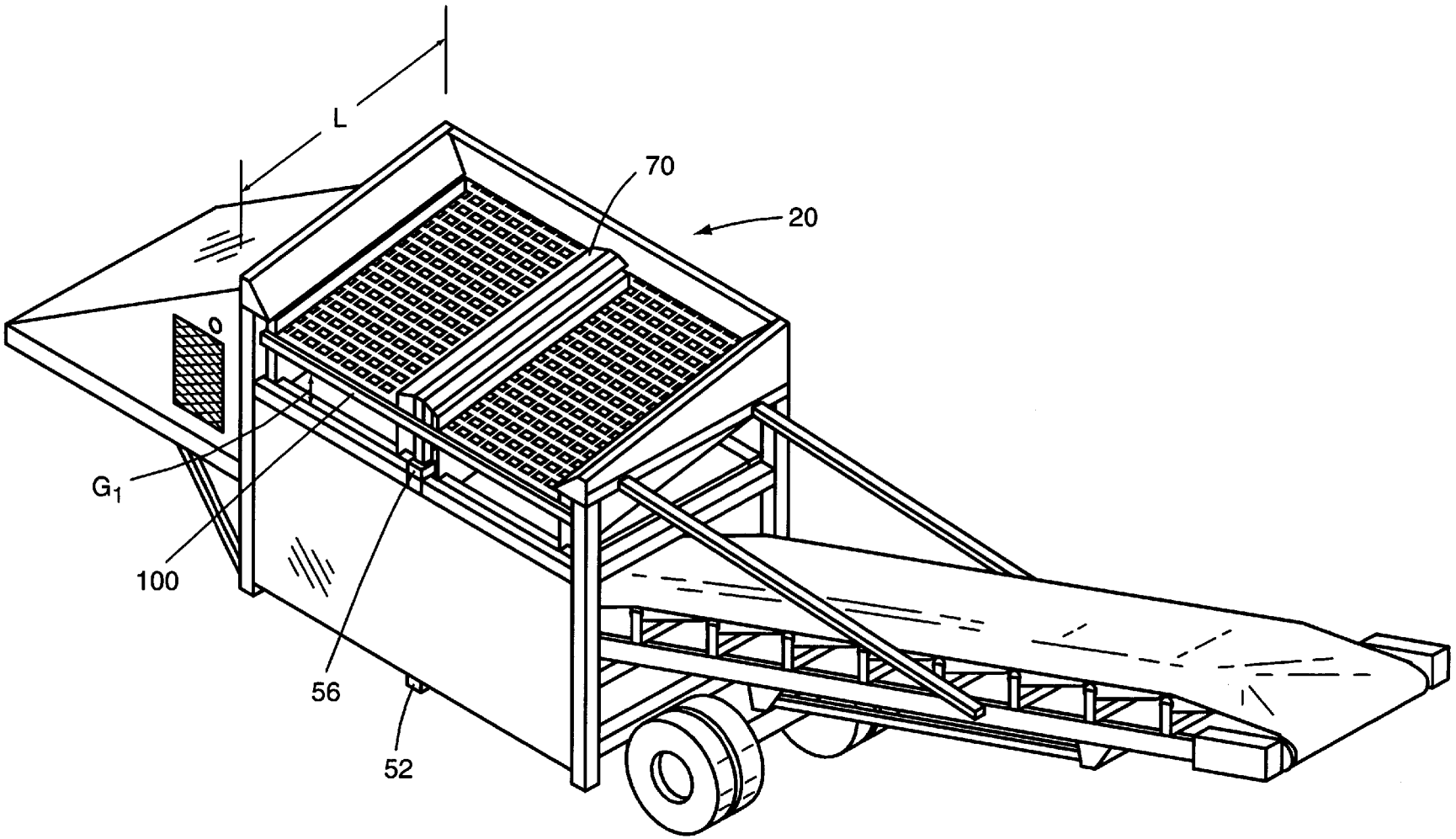
FIG. 2 is a view in perspective illustrating a preferred embodiment of the present invention.

A gap 60 is formed between the screen boxes 25 and 26, as shown in FIG. 3. The screen box 25 has an inner peripheral edge 65 that is adjacent the inner peripheral edge 66 of the screen box 26. The gap 60 between these inner peripheral edges provides the weights 42 and 43 with enough space to rotate without striking one another or the screen boxes. The beveled cap 70 overhangs the gap 60, and is mounted parallel to the gap 60 as shown in FIG. 2.

The cap 70 extends the entire length of the gap 60, and is slightly wider than the gap 60. The lateral edges of the cap 70 extend over the inner peripheral edges of the screen boxes 25 and 26 so that matter poured onto the cap 70 rolls down the beveled sides of the cap 70 and falls onto one of the upper screens, not into the gap 60. Of course, the cap 70 could be replaced by a cap-like structure mounted directly to one of the screen boxes, which overhangs the other screen box or a lip on the other screen box.

One advantage of the present invention is the independent operation of each screen box. Each of the hydraulic motors 27 and 28 is preferably separately connected to the hydraulic pump that is part of the powerplant 22. Additionally, each screen box is independently mounted to the housing 20. The hydraulic motors 27 and 28, therefore, can be driven at different rates for the purpose of reciprocatingly driving the screen boxes 25 and 26 at different rates or the same rate, but out of phase with one another.

Because of the independent operation of each screen box and its drivingly linked drive system, the present invention can be constructed in a modular manner by mounting additional screen box and drive systems together to make a screening plant of any desired width.

Conventionally, limitations are placed on the ultimate width of a screening plant due to the fact that screen box frame members must increase in strength, and therefore size, in order to widen the screen surface. As those frame members increase in size, several characteristics of the conventional machine are affected that are not affected with the present invention.

Firstly, the mass of the screen box is affected. Increasing the mass of the screen box necessitates an increase in the size of the housing which supports the screen box.

The second parameter which is affected by increasing the width of the screen box is the "throw" or amplitude of oscillation of the screen box. As the screen box's mass increases, the amplitude of oscillation must be decreased to prevent wear. Because it is advantageous to have a large amplitude, decreasing it is undesirable.

Figure 4:
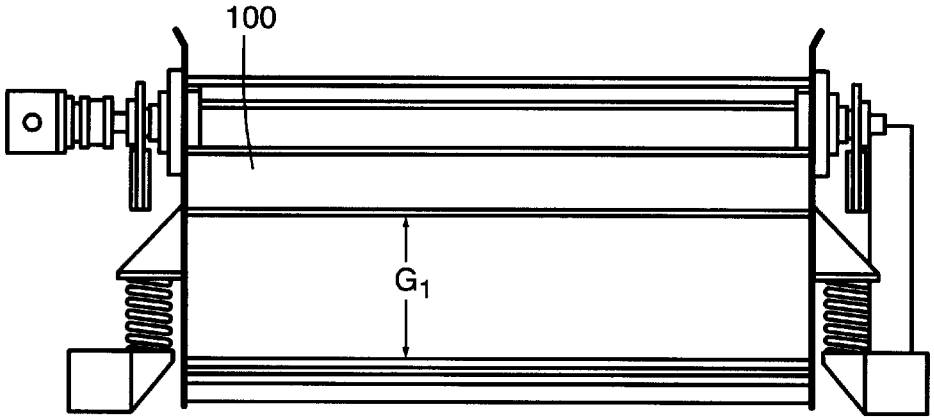
FIG. 4 is a front view illustrating a screen box.
Figure 5:
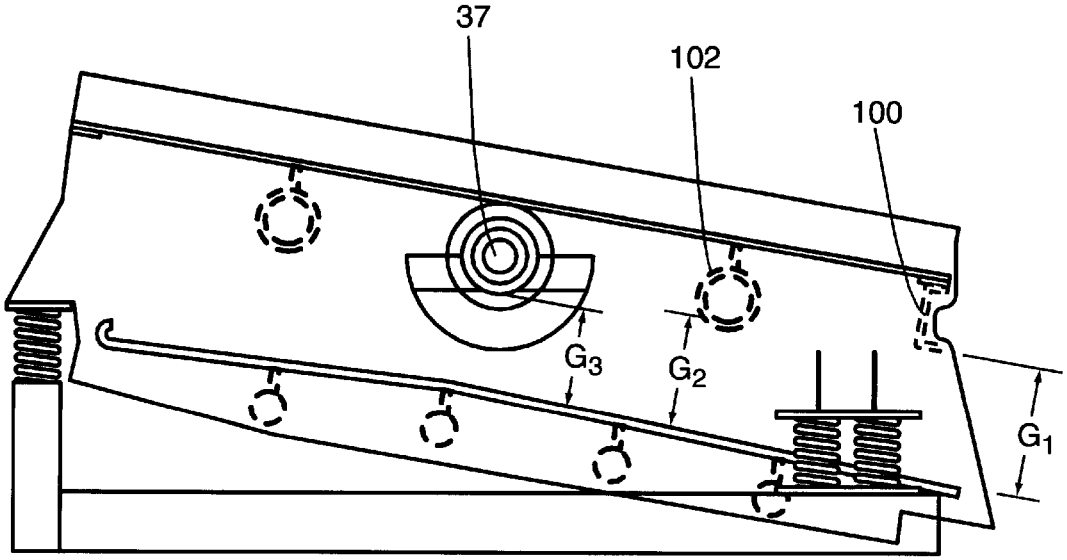
FIG. 5 is a side view of the screen box illustrated in FIG. 4.
Figure 6:
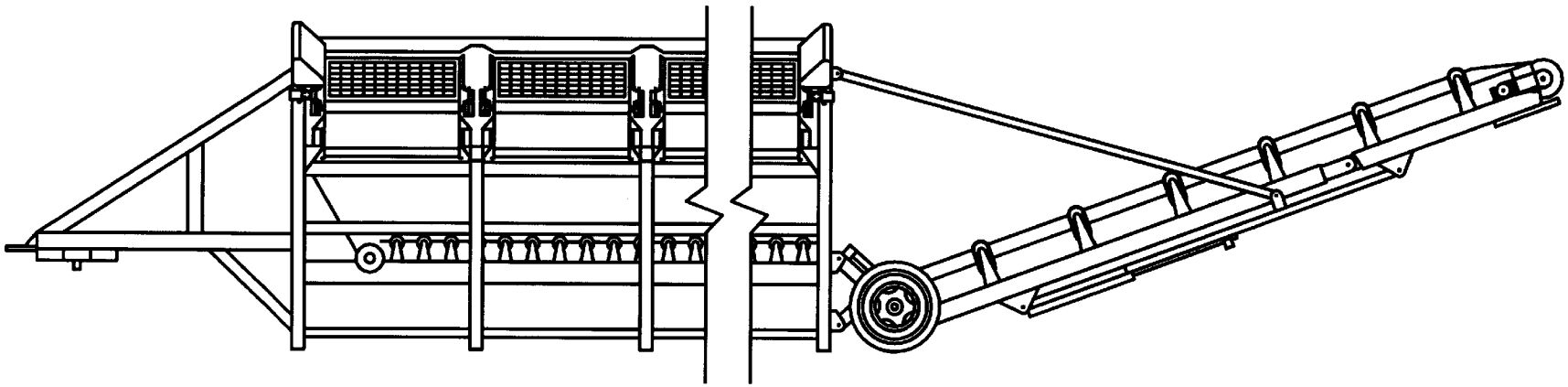
FIG. 6 is a front view illustrating an alternative embodiment of the present invention.

Thirdly, and perhaps most significantly, gaps are formed between the lower screen surface and the closest surface above the lower screen. For example, in FIGS. 2, 4 and 5, gaps $G_1$, $G_2$ and $G_3$ are shown between the lower screen surface and the upper screen's front support member 100, the support tube 102 and the driven shaft 37, respectively. The smallest of these gaps limits the maximum size of particles that can be dropped down onto the lower screen and eventually shaken off of the lower screen. A particle larger than the smallest gap, $G_3$, will not pass through the gap $G_3$, and would therefore prevent any material too large to be sifted through the leftward half of the lower screen shown in FIGS. 4 and 5 from being shaken off of the lower screen.

The gaps $G_1$, $G_2$, and $G_3$, or their equivalents in conventional machines, must decrease in size as the width of the conventional screen box is increased, due to the need for stronger (and therefore larger) supports and drive shafts on a wider screen box. However, by widening the screening plant under the modular principle of the present invention, the gaps $G_1$, $G_2$, and $G_3$ never decrease, because widening of the screening plant simply involves adding another modular screen box with the same gaps until the screening plant is the desired width. Because the weight of each screen does not increase with increased screening plant width, the throw and frequency of oscillation can be high, which reduces the likelihood of binding. Additionally, the throw and frequency can be high without the need for a large, expensive drive system which would be necessary with a heavier screen box.

A second advantage of the present invention is the strength and durability of the entire apparatus due to the configuration of the screen boxes, supports and drive systems. The screen boxes 25 and 26 are only a few feet wide and supported at opposite ends. This support at opposite ends is possible by the interposition of the beam 56, and is made extremely strong by supporting the beam 56 at its ends with the legs 52 and 54. The frame members of the screen boxes 25 and 26 are strong enough that the sum total weight that the array of screen boxes can support is much greater than the weight a conventional screen box can support.

Additionally, because there are two or more independent screen boxes with two or more independent drive systems, there is no longer a single drive shaft extending the entire length of the screen box. Such a large driveshaft is expensive and difficult to construct and maintain.

Furthermore, because the present invention includes independent drive systems to drive each screen box, each drive system component can be smaller, and therefore less expensive, than those needed to power a conventional single screen box. Many of the drive components can be disproportionately less expensive to manufacture and construct than conventional components.

Because they are independently driven and independently attached to the housing, each screen box responds independently to the load on it. For example, if one screen box is loaded with an especially heavy load of material, its amplitude of reciprocation (throw) will be lower than the screen box with only a normal load. The amplitude affects the rate at which matter moves off the screen boxes. Therefore, the normally loaded screen box will screen the matter at the normal rate, while the abnormally loaded screen box will screen at a slower rate.

Independent operation of the drive systems also permits the use of vibration control measures. The phase relationship of the drive systems could be predetermined to reduce or eliminate vibration imparted to the housing. For example, if the screen boxes are reciprocated at a phase relationship in which one screen box is 180 degrees out of phase with the other screen box, the force applied to the housing by one screen box would be continuously counteracted by an equal and opposite force applied by the other screen box. This could reduce or eliminate vibration of the housing, if desired. This phase relationship can be varied to that preferred to obtain desired results.

Figure 7:
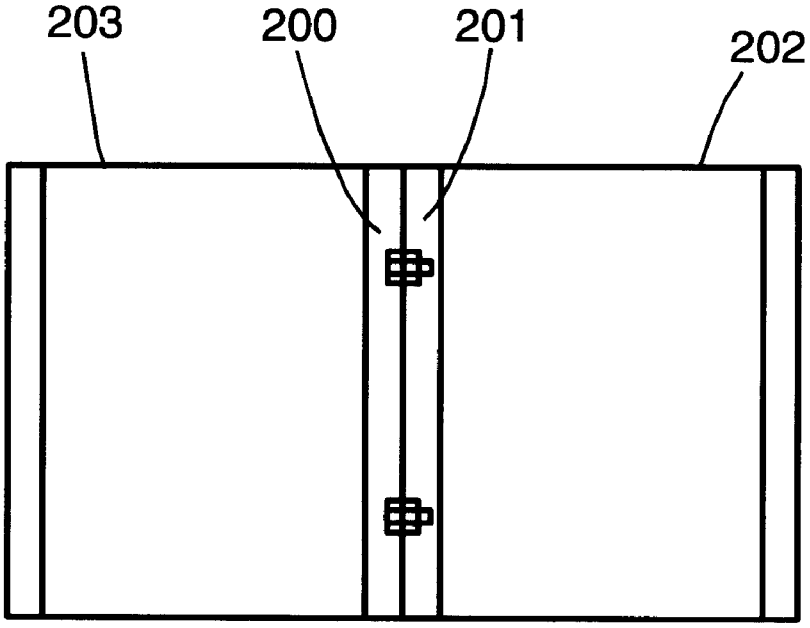
FIG. 7 is a top schematic view illustrating an alternative beam.

Although the support member, preferably the beam 56, is described and shown as one piece, it can be substituted by two or more beams connected together directly or through other elements as shown in FIG. 7. Due to the modular principle of the invention, it is contemplated that each module could have its own separate housing or "beam" for supporting the edge of the screen box. However, once connected together to form the screening plant, the separate beams function as a single support member for the purpose of the invention. Such a configuration is shown in FIG. 7 by the housings 202 and 203, which are mounted together with the separate beams 200 and 201 forming a single beam upon which the inner edges of a pair of screen boxes could rest.

While certain preferred embodiments of the present invention have been disclosed in detail, it is to be understood that various modifications may be adopted without departing from the spirit of the invention or scope of the following claims.

We claim:

1. A screening plant having a housing including a funnel region into which materials are poured, the screening plant comprising:

(a) a first screen box mounted to the housing in the funnel region, the first screen box having an inner peripheral edge;

(b) a first prime mover drivingly linked to the first screen box for driving the first screen box in reciprocating motion;

(c) a second screen box mounted to the housing in the funnel region, the second screen box having an inner peripheral edge which is mounted adjacent to the first screen box's inner peripheral edge, and the second screen box being substantially coplanar with the first screen box;

(d) a second prime mover drivingly linked to the second screen box for driving the second screen box in reciprocating motion.

2. A screening plant in accordance with claim 1, further comprising a first support member extending from the housing to near the inner peripheral edge of the first screen box and mounting thereto, and a second support member extending from the housing to near the inner peripheral edge of the second screen box, and mounting thereto.

3. A screening plant in accordance with claim 1, further comprising a support member extending from the housing to near the inner peripheral edges of the first and second screen boxes, the first and second screen boxes being mounted to the support member.

4. A screening plant in accordance with claim 3, wherein the support member comprises a beam extending from the housing near a first beam end substantially parallel to the inner peripheral edges of the first and second screen boxes to the housing near a second, opposite beam end.

5. A screening plant in accordance with claim 4, further comprising at least one bias mounted between the inner peripheral edge of the first screen box and the support member, and at least one bias mounted between the inner peripheral edge of the second screen box and the support member.

6. A screening plant in accordance with claim 5, wherein the screening plant further comprises at least one leg extending downwardly from the support member to form a foot for resting on the earth in an operable position.

7. A screening plant in accordance with claim 1, further comprising a gap formed between the inner peripheral edge of the first screen box and the inner peripheral edge of the second screen box.

8. A screening plant in accordance with claim 7, further comprising a beveled cap mounted to the housing, the cap extending over the gap and over a portion of the inner peripheral edges of the first and second screen boxes.

9. A screening plant in accordance with claim 1, wherein the second screen box has a second peripheral edge and further comprising:

(a) a third screen box mounted to the housing in the funnel region, the third screen box having an inner peripheral edge which is mounted adjacent to the second screen box's second peripheral edge, and the third screen box is substantially coplanar with the second screen box;

(b) a third prime mover drivingly linked to the third screen box for driving the third screen box in reciprocating motion.

* * * * *